US005370009A

United States Patent [19]

Isozumi

[11] Patent Number: 5,370,009

[45] Date of Patent: Dec. 6, 1994

[54] STARTING MOTOR

[75] Inventor: Shuzo Isozumi, Himeji, Japan

[73] Assignee: Mitsubishi Denki Kabushiki Kaisha, Tokyo, Japan

[21] Appl. No.: 33,802

[22] Filed: Mar. 18, 1993

[30] Foreign Application Priority Data

Mar. 19, 1992 [JP] Japan ..... 4-093308

[51] Int. Cl.[5] ..... F02N 15/06

[52] U.S. Cl. ..... 74/7 C; 74/7 A; 74/7 E

[58] Field of Search ..... 74/7 A, 7 E, 7 C

[56] References Cited

U.S. PATENT DOCUMENTS

| | | | |
|---|---|---|---|
| 4,507,978 | 4/1985 | Tanaka et al. | 74/7 E |
| 4,899,604 | 2/1990 | Morishita et al. | 74/7 E X |
| 4,938,084 | 7/1990 | Morishita et al. | 74/7 R X |
| 4,995,275 | 2/1991 | Okamoto et al. | 74/7 A |
| 5,016,484 | 5/1991 | Morikane | 74/7 A X |
| 5,028,805 | 7/1991 | Isozumi | 290/48 |
| 5,167,162 | 12/1992 | Nagashima et al. | 74/7 C |

FOREIGN PATENT DOCUMENTS

| | | |
|---|---|---|
| 0494681 | 7/1992 | European Pat. Off. . |
| 2574483 | 6/1986 | France . |
| 55-53727 | 12/1980 | Japan . |

*Primary Examiner*—Allan D. Herrmann
*Attorney, Agent, or Firm*—Sughrue, Mion, Zinn, Macpeak & Seas

[57] ABSTRACT

A starter motor for an internal combustion engine having an overrunning clutch (40) which transfers rotation of a d.c. motor to a pinion gear for driving an internal combustion engine. An outer member (41) of the overrunning clutch (40) is slidable along an output shaft (7). When the clutch is slid toward the engine (forward) the d.c. motor is electrically energized and its rotation is imparted to the output shaft (7) via a planetary reduction gear (13). When the overrunning clutch (40) is in this position, the clutch outer member (41) is coupled to the output shaft (7) by helical spline (8). Clutch inner member (22), which is caused to rotate by the rollers (23), transmits rotary motion to the pinion, thus rotating the engine. The overrunning clutch is caused to slide along the output shaft by a shift lever (34) which is moved forward and rearward by an electromagnetic switch (31). The shift lever has a two-pronged lower end engaged with an annular engagement groove (41c). A retaining ring (27) is fitted in the output shaft to prevent rearward motion of the overrunning clutch past a predetermined point. The clutch outer member (41) is provided with a rear end portion having an inner diameter which is larger than the outer diameter of the retaining ring (27) so that the rear end portion of the clutch overhangs the retaining ring. This shortens the distance between the forward position of the clutch outer member and the retaining ring, which in turn reduces the external length of the starter motor.

9 Claims, 3 Drawing Sheets

STARTING MOTOR

BACKGROUND OF THE INVENTION

1. Field of the Invention

The present invention relates to a starting motor which transmits rotation from an armature shaft of a d.c. motor to an output shaft, transmits the rotation of the output shaft to a pinion through an overrunning clutch, and starts an engine.

2. Description of the Prior Art

In FIG. 4, there is shown a cross sectional view of the essential parts of a conventional starting motor. A d.c. motor 1 has an armature shaft 2 extended from an armature, and the armature shaft 2 has a front end part provided with a sun gear 2*a*, which is constituted by a small gear. Reference numeral 3 designates a yoke which has field poles (not shown) mounted thereto. Reference numeral 4 designates an intermediate bracket which supports a front part side of the armature shaft 2 through a bearing 5. Reference numeral 6 designates a front bracket which is coupled to the yoke 3 through the intermediate bracket 4.

Reference numeral 7 designates an output shaft which is arranged at a front end of the armature shaft 2 through a steel ball 11 to be coaxial with the armature shaft 2, and which has an intermediate part provided with a helical spline 8. The output shaft has a clutch outer stopper 10 formed thereon before the helical spline 8 through an annular groove 9. The helical spline 8 has a plurality of tooth spaces 8*a* formed therein at equal pitches in the circumferential direction. There is formed a single through tooth space 8*b* between every adjoining tooth space 8*a*. The stopper 10 has through cutouts 10*a* formed therein to correspond to the through tooth spaces 8*b*. The output shaft 7 has a recess of thread portion 7*b* provided thereon behind the helical spline 8 to have a small diameter.

Reference numeral 13 designates a planetary reduction gear which is constituted as follows: Reference numeral 14 designates a plurality of planetary gears which mate with the sun gear 2*a*, and which are supported by supporting pins 15 through bearings 16. The supporting pins 15 are fixed to a carrier 7*a* which is formed by a flange at a rear end of the output shaft 7. Reference numeral 17 designates an internal gear frame which is fixed in the front bracket 6, and which has an inner periphery formed with internal teeth 17*a*, the internal teeth causing the planetary gears 14 meshed therewith to revolve. The internal gear frame 17 has a front end inner periphery supporting the output shaft at its rear end part through a bearing 18.

Reference numeral 20 designates an overrunning clutch which is carried on the output shaft 7, and which is constituted as follows: Reference numeral 21 designates a clutch outer member which has helical spline threads 21*a* formed thereon to engage with the tooth spaces 8*a* of the helical spline 8 on the output shaft 7. Reference numeral 22 designates a clutch inner member which transmits one-way rotation to the clutch outer member 21 through rollers 23, which is supported by the front bracket 6 through a bearing 24 and which supports the output shaft 7 through a bearing 25. Reference numeral 26 designates an engagement ring which is fitted into a rear end outer periphery of the clutch outer member 21. Between the engagement ring and the rear end of an enlarged portion of the clutch outer member, there is formed an annular engagement groove 21*b*. Reference numeral 27 designates a retaining ring which is fitted in the output shaft 7 to receive the clutch outer member 21 at a predetermined position when the clutch outer member 21 moves backward, and which is constituted by an E-shaped retaining ring.

Reference numeral 28 designates a pinion which is carried on a front end of the clutch inner member 22 by spline connection, which has a front end held by a stopper 29, and which is urged in a forward direction by a compression spring 30.

Reference numeral 31 designates an electromagnetic switch which is mounted on the front bracket 6, which has a plunger 32 forming a movable core, and which has a hook 33 inserted in and supported by the plunger 32 so that the hook 33 has a front end projected. Reference numeral 34 designates a shift lever which has a two-pronged upper end engaged with the hook 33, which has a two-pronged lower end engaged with the annular engagement groove 21*b* of the overrunning clutch 20 in an axial direction, and which is supported by the front bracket 6 at an intermediate projection 34*a* to be turnable, using the intermediate projection 34*a* as a fulcrum. Reference numeral 35 designates a rubber caulk which is fitted in a cutout of the front bracket 6.

Mounting the overrunning clutch 20 to the output shaft 7 is as follows: The helical spline threads 21*a* of the clutch outer member 21 of the overrunning clutch 20 which has been assembled is passed through the through cutouts 10*a* of the stopper 10, and through the tooth spaces 8*b* of the helical spline 8 until the threads 21*a* has reached the recess 7*b* of the thread portion. The clutch outer member 21 is turned by a half pitch of the threads 21*a*, the threads 21*a* are engaged with the tooth spaces 8*a* of the helical spline 8, and the clutch outer member 21 is returned in a forward direction. Then, the retaining ring 27 is fitted in the output shaft 7 to restrict the backward position of the clutch outer member 21. Under the conditions, when the overrunning clutch 20 moves forwardly, front ends of the threads of the clutch outer member 21 hit against the stopper 10 to restrict the forward position of the clutch outer member 21.

The operation of the conventional starting motor will be explained. When a starting switch for an engine of a vehicle etc., an exciting coil (not shown) of the electromagnetic switch 31 is energized to inwardly attract or withdraw the plunger 32 the shift lever 34 is turned by the plunger counterclockwise (refer to FIG. 4) through the hook 33 to move the overrunning clutch 20 forwardly. The forward movement of the overrunning clutch 20 causes the pinion 28 to mate with a ring gear of the engine. The withdrawal of the plunger 32 causes a movable contact (not shown) to get in pressure contact with a pair of fixed contacts (not shown), thereby closing an energizing circuit to the d.c. motor 1. As a result, the armature rotates, the rotation of the armature shaft 2 is transmitted to the pinion 28 through the planetary reduction gear 13 and the overrunning clutch 20 to rotate the ring gear of the engine, thereby starting the engine.

When the engine has started, high speed rotation of the engine drives the pinion 28 in the same direction. However the provision of the overrunning clutch 20 prevents the armature shaft 2 from receiving the driving force.

When the engine has started and the starting switch has been turned off, the plunger 32 of the electromagnetic switch 31 moves forwardly and returns to the forward position to turn the shift lever 34 clockwise in this figure to return it to the home position, causing the overrunning clutch 20 to move backwardly and return to the home position.

In the conventional starting motor as stated above, when the overrunning clutch 20 is at the backward position, the annular engagement groove 21*b* is located ahead of the retaining ring 27. This means that the distance between the front end of the overrunning clutch 20 and the retaining ring 27 becomes great, which creates a problem in that the external length of the starting motor is enlarged.

SUMMARY OF THE INVENTION

It is an object of the present invention to solve the problem, and to provide a starting motor wherein the length of an overrunning clutch in a forward side with respect to a retainer fitted in an output shaft is shortened to reduce the external length of the starting motor.

The foregoing and other objects of the present invention have been attained by providing a starting motor comprising an overrunning clutch including an output shaft adapted to receive rotation of an armature shaft of a d.c. motor, a clutch outer member adapted to be coupled to the output shaft through a helical spline, and a clutch inner member coupled to the clutch outer through a roller and transmitting a one-way rotation to a pinion provided at a front end side; a retainer fitted to a rear end part of the output shaft, and adapted to receive a rear end of the clutch outer member which has returned to a backward position; a supporting frame fixed to a fixed part, and supporting the rear end part of the output shaft through a bearing; and a shift lever having a lower end part engaged with an annular engagement groove in an axial direction, and turning to move the overrunning clutch to either one of a forward position and the backward position, the annular engagement groove provided with a rear side part of the clutch outer; wherein the annular engagement groove in the overrunning clutch is adapted to have a rear end side inner periphery overhung the retainer when the clutch outer member is in the backward position, and the inner periphery is formed to have a larger diameter than an outer periphery of an outer end of the bearing supporting part of the supporting frame.

In accordance with the present invention, the length of the overrunning clutch in a forward direction with respect to the retainer is shortened to reduce the external length of the starting motor.

In accordance with the present invention, the position of the annular engagement groove of the clutch outer member is shifted backwardly with respect to the position of the retainer. The distance between the front end of the overrunning clutch and the retainer is accordingly shortened to make the shape of the starting motor smaller in an axial direction.

DESCRIPTION OF THE PREFERRED EMBODIMENTS

Figure 1:
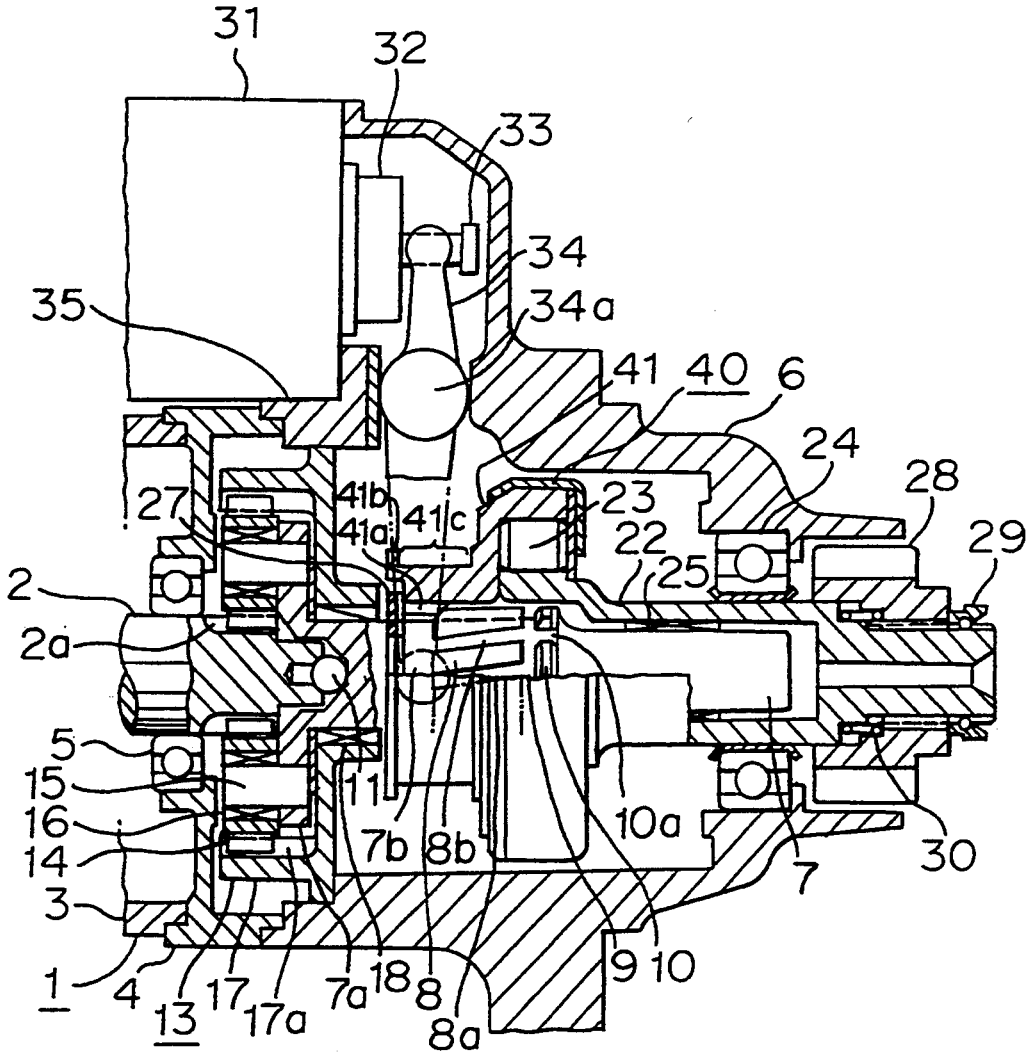
FIG. 1 a cross sectional view of the essential parts of the starting motor according to a first embodiment of the present invention.

Referring now to FIG. 1, there is shown an axial cross sectional view showing the essential parts of a first embodiment of the starting motor of the present invention.

Figure 4:
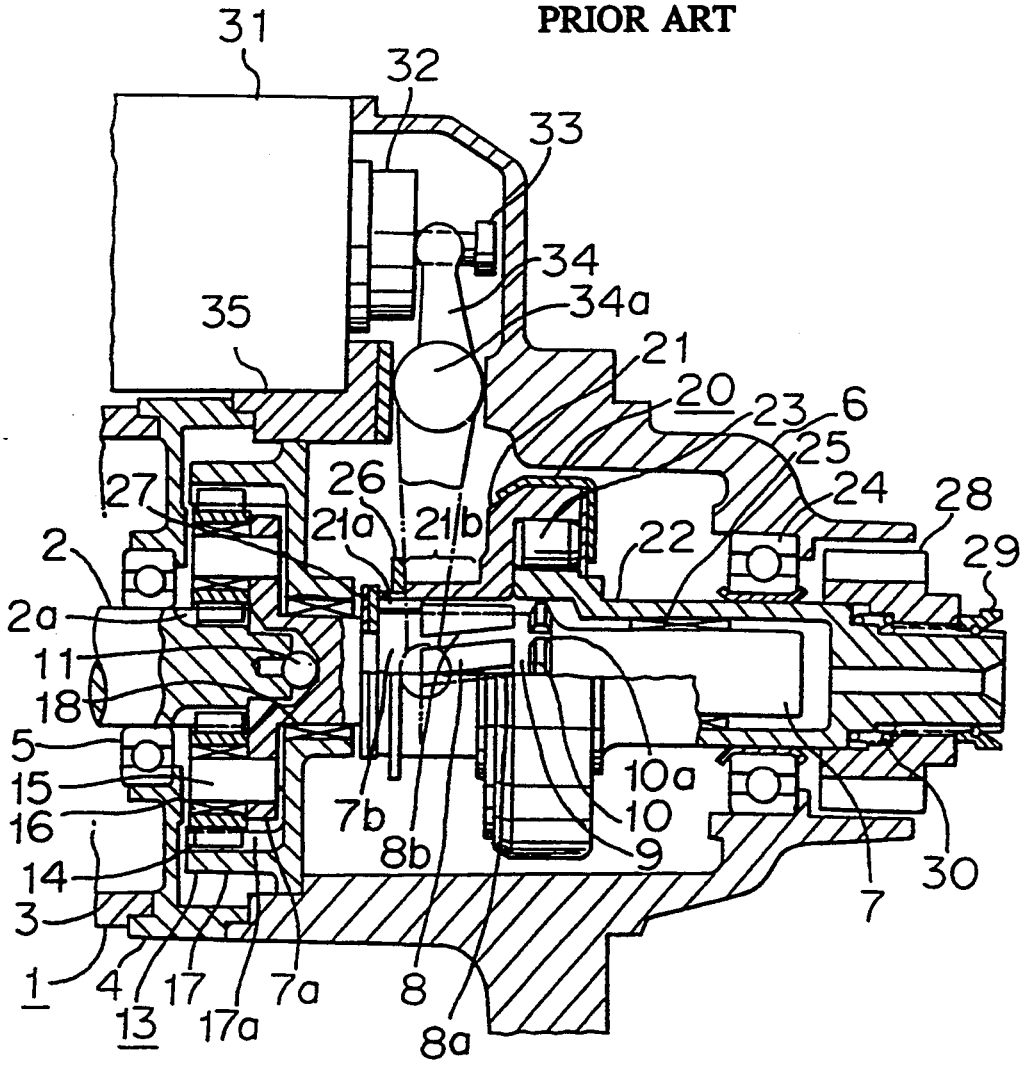
FIGURE 4 PRIOR ART
FIG. 4 is a cross sectional view showing the essential parts of a conventional starting motor.

Reference numerals 1–11, 13–18, 22–25, 27–35, 2*a*, 7*a*, 7*b*, 8*a*, 8*b*, 10*a*, 17*a* and 34*a* designate parts similar to those shown in FIG. 4. Reference numeral 40 designates an overrunning clutch which is mounted onto the output shaft 7 and which comprises a clutch outer member 41 and the clutch inner member 22, the clutch inner member receiving one-way rotation from the clutch outer member 41 through the rollers 23. The clutch outer member 41 has an inner peripheral portion formed with helical spline threads 41*a*, which are engageable with the tooth spaces 8*a* of the helical spline 8 of the output shaft 7. The clutch outer member 41 has the inner diameter of a rear end portion formed to be larger than the outer diameter of the retaining ring 27 so that the rear end portion overhangs the retaining ring and is extended. The clutch outer 41 has a rear end outer member periphery provided with an engagement projection 41*b*. Between the engagement portion 41*b* and a rear end surface of an enlarged portion of the clutch outer member 41, there is formed an annular engagement groove 41*c*, which is engaged with a lower end of the shift lever 34 in an axial direction.

Because the rear end portion of the clutch outer member 41 is extended backwardly to overhang the retaining ring 27 as stated above, the annular engagement groove 41*c* is formed to be shifted backwardly with respect to the location of the retaining ring 27 in comparison with the conventional starting motor. The distance between the front end position of the clutch outer member 41 and the location of the retaining ring 27 is shortened accordingly in companion with the conventional device. As a result, the distance between a front end of the overrunning clutch 40 and the retaining ring 27 is also shortened to reduce the external length of the starting motor.

Figure 2A:
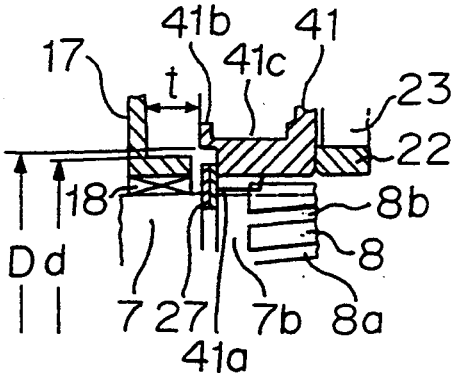
FIG. 2A is a cross sectional view showing the relation between an annular engagement groove and a retainer of a clutch outer member an overrunning clutch.

Referring now to FIG. 2A, there is shown an arrangement relation between the rear end portion of the clutch outer member 41 of the overrunning clutch 40 and a bearing supporting portion of an end plate of the internal gear frame 17. The inner diameter D of the rear end portion of the clutch outer member 41 is formed to be greater than the outer diameter d of the bearing supporting portion of the internal gear frame 17. In this manner, the distance t between the rear end of the clutch outer member 41 and the end plate of the internal gear frame 17 becomes smaller in comparison with the conventional device.

Figure 2B:
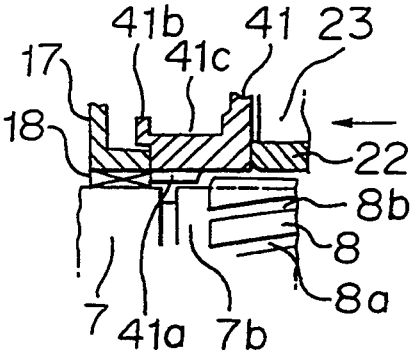
FIG. 2B is a cross sectional view showing the state wherein the clutch outer member has been moved backwardly to mount the overrunning clutch to an output shaft.

Referring now to FIG. 2B, there is shown a state wherein the clutch outer member 41 is backwardly inserted in order to mount the overrunning clutch 40 onto the output shaft 7. It is seen that the clutch outer member 41 has been backwardly moved while the inner diameter of the rear end portion of the clutch outer member 41 evades the outer diameter of the bearing supporting portion of the inner gear frame 17.

Figure 3:
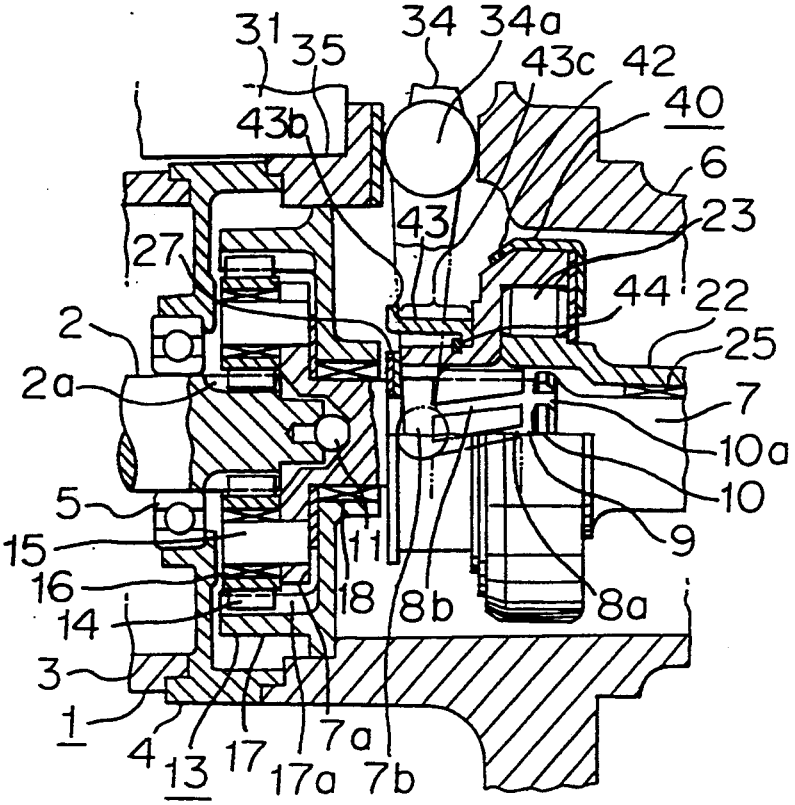
FIG. 3 is a cross sectional view showing the essential parts of the starting motor according to a second embodiment of the present invention.

Referring now to FIG. 3, there is shown a cross sectional view showing the essential parts of the staring motor according to a second embodiment of the present invention. The clutch outer member 42 of the overrunning clutch 40 has an engagement annulus 43 fitted onto the rear end side outer periphery to be fixed by use of a retaining ring 44. The engagement annulus 43 has a rear end provided with an engagement projection 43*b*. Between the engagement projection 43*b* and a rear end surface of an enlarged portion of the clutch outer member 42, there is formed an annular engagement 43*c*. The inner diameter of the engagement annulus 43 is formed to be greater than the outer diameter of the retaining ring 27 and the outer diameter of the bearing supporting portion of the internal gear frame 17. When the clutch outer member 42 is located at the backward position, the annular engagement groove 43*c* has a rear end side overhanging the retaining ring 27.

What is claimed is:

1. A starting motor comprising:

an overrunning clutch (40) including an output shaft (7) adapted to receive rotation of an armature shaft (2) of a d.c. motor (1), a clutch outer member (41) adapted to be coupled to the output shaft (7) through a helical spline (8), and a clutch inner (22) coupled to the clutch outer member (41) through a roller (23) and transmitting a one-way rotation to a pinion (28) provided at a front end side;

a retainer (27) fitted to a rear end part of the output shaft (7), and adapted to receive a rear end of the clutch outer member (41) which has returned to a backward position;

a supporting frame (17) fixed to a fixed part, and supporting the rear end part of the output shaft (7) through a bearing (18); and a shift lever (34) having a lower end part engaged with an annular engagement groove (41*c*) in an axial direction, and turning to move the overrunning clutch (40) to either one of a forward position and the backward position, the annular engagement groove (41*c*) provided with a rear side part of the clutch outer member (41);

a stopper 10 which is formed on the output shaft 7 as one-piece construction at the side of the pinion 28 with respect to the helical spline 8 to stop the movement of the clutch outer member 41 toward the front end side at a predetermined position;

wherein the annular engagement groove (41*c*) in the overrunning clutch (40) is adapted to have a rear end side inner periphery overhang the retainer (27) when the clutch outer member (41) is in the backward position, and the inner periphery is formed to have a larger diameter than an outer periphery of an outer end of the bearing supporting part of the supporting frame (17).

2. A starting motor according to claim 1, wherein the clutch outer member (41) has a rear end outer periphery provided with an engagement portion (41*b*).

3. A starting motor according to claim 2, wherein the annular engagement groove (41*c*) is formed between the engagement portion (41*b*) and an enlarged portion of the clutch outer member (41).

4. A starting motor according to claim 1, wherein an engagement annulus (43) is engaged with the clutch outer member (42) to provide the annular engagement groove (43*c*).

5. A starting motor according to claim 4, wherein the engagement annulus (43) is engaged with the clutch outer member (42) by means of a retainer (44).

6. A starting motor according to claim 5, wherein the retainer (44) is a retaining ring.

7. A starting motor according to claim 4, wherein the engagement annulus (43) has a rear end provided with an engagement projection (43*b*).

8. A starting motor according to claim 7, wherein the annular engagement groove (43*c*) is formed between the engagement projection (43*b*) and an enlarged portion rear end of the clutch outer member (42).

9. A starting motor according to claim 8, wherein the engagement annulus (43) has an inner diameter formed to be larger than the outer diameter of the retainer (27) and that of the bearing supporting part of the supporting frame (17).

* * * * *